United States Patent [19]

Ploeger, Jr.

[11] Patent Number: 4,701,062

[45] Date of Patent: Oct. 20, 1987

[54] PRINTING RIBBON SPOOL

[76] Inventor: Walter Ploeger, Jr., Box 869, 420 Williams Rd., Arden, N.C. 28704

[21] Appl. No.: 781,177

[22] Filed: Oct. 1, 1985

Related U.S. Application Data

[63] Continuation-in-part of Ser. No. 668,550, Nov. 5, 1984, abandoned.

[51] Int. Cl.[4] ..... B41J 31/14

[52] U.S. Cl. ..... 400/202.1; 400/242

[58] Field of Search ..... 400/197, 200, 202, 202.1, 400/202.2, 202.3, 242; 101/401.1; 215/247, 274

[56] References Cited

U.S. PATENT DOCUMENTS

| | | | |
|---|---|---|---|
| 1,958,764 | 5/1934 | Mosfelt et al. | 400/202.2 X |
| 2,530,697 | 11/1950 | Higgins | 400/202.2 X |
| 2,695,092 | 11/1954 | Pelton | 400/202.3 X |
| 2,723,741 | 11/1955 | Carlson | 400/202.2 X |
| 2,743,470 | 5/1956 | Horowitz | 400/202.2 X |
| 2,761,539 | 9/1956 | Furman et al. | 400/202.2 X |
| 3,101,863 | 8/1963 | Jackson, Sr. | 215/247 |
| 3,819,026 | 6/1974 | Ploeger, Jr. et al. | 400/202.1 |
| 3,987,137 | 10/1976 | Neumann et al. | 101/401.1 X |
| 4,115,012 | 9/1978 | Ploeger, Jr. et al. | 400/202.1 X |
| 4,506,807 | 3/1985 | Anderson | 215/247 X |

FOREIGN PATENT DOCUMENTS

| | | | |
|---|---|---|---|
| 156756 | 9/1984 | Japan | 400/202.2 |
| 143424 | 11/1930 | Switzerland | 400/197 |

*Primary Examiner*—Edgar S. Burr
*Assistant Examiner*—James R. McDaniel
*Attorney, Agent, or Firm*—Seidel, Gonda, Goldhammer & Abbott

[57] ABSTRACT

A printing ribbon spool is disclosed for maintaining the print-out density or consistency of a printing ribbon. The spool contains a sealed reservoir of ink. Within the reservoir there is provided a sealed container of ink which communicates with the reservoir when it is desired to use the spool.

20 Claims, 4 Drawing Figures

FIG. 1
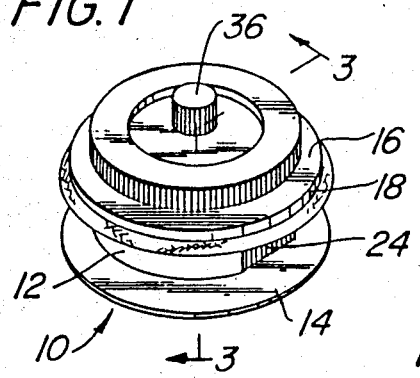
FIG. 2
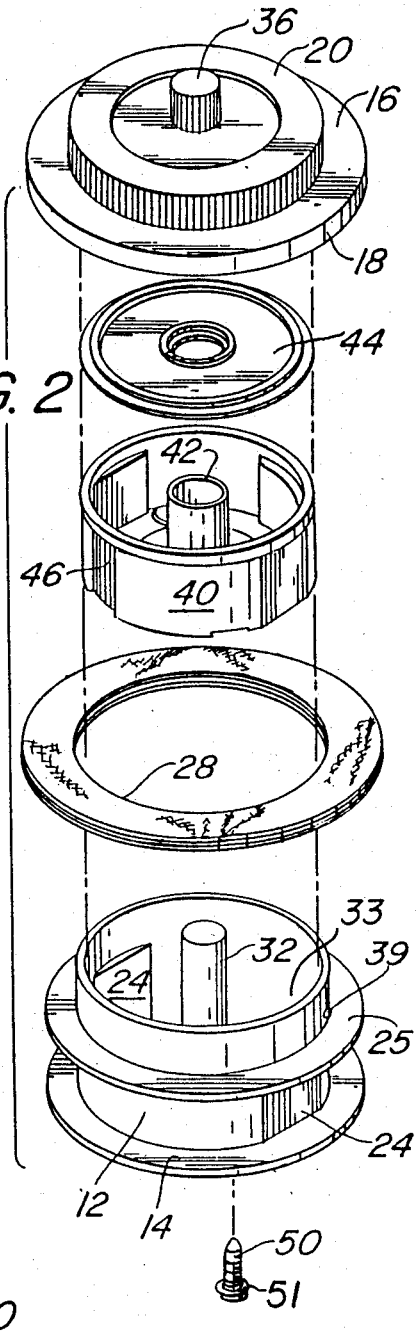
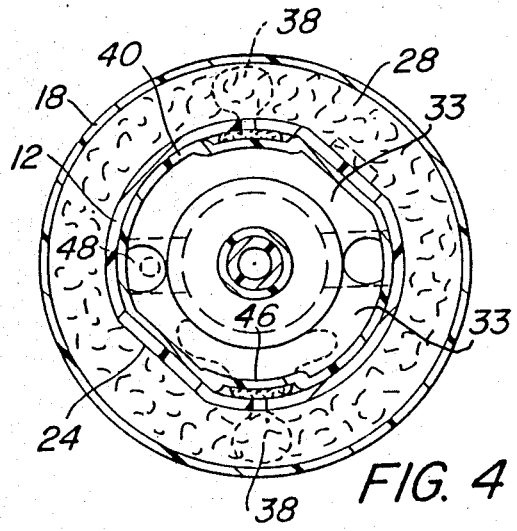
FIG. 4
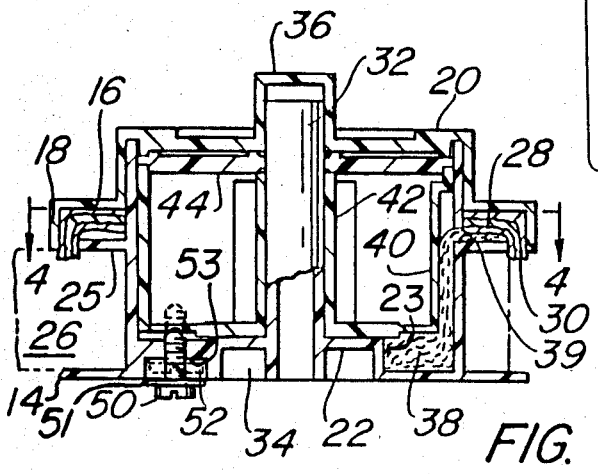
FIG. 3

PRINTING RIBBON SPOOL

RELATED APPLICATION DATA

This is a continuation-in-part of U.S. patent application Ser. No. 668,550 filed Nov. 5, 1984, now abandoned.

BACKGROUND OF THE INVENTION

The present invention is directed generally to a printing ribbon spool. More specifically, the present invention is directed to a printing ribbon spool of the type having a storage means for storing ink internally of the spool and a means for transferring ink from the storage means to the printing ribbon.

Printing ribbon spools of the aforementioned type are generally known. See, U.S. Pat. Nos. 3,819,026 and 4,115,012, incorporated herein by reference. These patents generally disclose a printing ribbon spool for maintaining the printout density or consistency of a printing ribbon by contact between a woven or knitted ink pad on the spool and a side edge of the ribbon. Ink is communicated to the pad from a hermetically sealed reservoir internally of the spool by way of woven or knitted wicks which communicate with the reservoir through wick holes substantially smaller in diameter than the transverse width of the wicks in their normal uncompressed condition.

A problem with the printing ribbon spools disclosed in the aforementioned patents is that they cannot be stored or shipped under adverse conditions, i.e., extreme conditions of temperature or heat. A drop in ambient pressure, such as would occur during shipment by air freight, causes the ink to bleed from the hermetically sealed reservoir to the ink pad. The ink in the reservoir is thus depleted even before the spool is used and shipment becomes messy because of the leaking ink. Storing or transporting the ribbon spool at elevated temperatures, such as may occur in the trunk of a car on a sunny day, results in the same bleeding action and creates the same undesirable conditions.

An additional problem with the printing ribbon spools described in the aforementioned patents is that they are limited in printing speed. It has been found that there is a direct relationship between the diameter of the wick holes and the speed at which the printing spool may operate without degredation or inconsistency in print-out density. That is, the faster the ribbon is unwound from the spool, the faster the ink needs to be conducted from the reservoir to the ink pad to maintain a consistent print-out density. Experimentation has shown that if the diameter of the wick holes of the '012 and '026 patent spools is made larger than 0.094", ink will bleed from the reservoir even in non-adverse storage conditions. This places a practical limitation on the size of the wick hole diameter that may be provided in those prior art spools. Thus, the speed at which prior art ribbon spools of the above-mentioned type can be driven is limited due to limitations in the maximum diameter of the wick holes.

Still a further problem with the printing ribbon spools described in the aforementioned patents is that the print-out density does change somewhat as the ink level in the reservoir decreases, even when operating at slower speeds. Initially, the ink level is equal to or above the level of the wick holes. The ink pressure causes the ink to be conducted to the pad at a greater rate than when the ink level drops below the level of the wick holes.

Still a further problem with prior art printing ribbon spools is that they have a limited shelf life. Although ink is stored in a hermetically sealed reservoir in the spool, the ink may bleed out of the reservoir over a period of time because the wick holes contact the ink even during storage.

These and other failings of the aforementioned prior art ribbon spools are overcome by the present invention.

Another kind of typewriter ribbon re-inking device is taught by U.S. Pat. No. 2,743,470. The '470 patent discloses a cylindrical casing having an ink scraper and an ink pad disposed therein. An ink storing chamber is also disposed in the casing above the ink pad and means are provided to allow the ink to pass from the chamber to the ink pad by means of a valve. A transverse slot for receiving the printing ribbon extends through the casing for re-inking the ribbon.

The '470's re-inking device is fraught with practical problems. The re-inking device must be either manually held over the ribbon or attached to the typewriter by a mechanical linkage. Additionally, the valve must be manually released for the purpose of replenishing the ink pad. Still further, the ink storage chamber is not hermetically sealed, and is not capable of being hermetically sealed without adversely affecting the device's operation. Moreover, the '470 patent's provision of an air hole from the chamber to the atmosphere does not permit a regulated flow of ink to the ink pad, i.e., ink may flow to the pad until it is saturated if the valve is maintained in the open position. Still further, when the valve is removed for purposes of reloading the chamber with ink, a quantity of ink will pass into the ink pad, possibly over-inking the pad before the chamber has been completely filled and the valve has been reinserted. Each opening of the valve allows air to enter the chamber, thus negating any possibility of maintaining a vacuum in the chamber.

Additional problems are associated with the use of the '470 patent's re-inking device. This device cannot be used in any but an upright position since ink would leak outside the chamber through the air hole provided in the chamber wall.

These and other failings of the '470 patent's re-inking device are overcome by the present invention.

SUMMARY OF THE INVENTION

The present invention is directed to a printing ribbon spool which may have a ribbon wound thereon or which may be used as an idler for contact with ribbon coupled at its ends to a pair of spools. The invention comprises an annular spool body having a hub and a pair of radially outwardly directed flanges spaced from one another by a distance so as to accommodate therebetween a printing ribbon. An annular deformable pad of fabric is supported at one of said flanges so that an exposed edge of the pad will have contact with a side edge of at least a portion of a ribbon disposed between the flanges.

A hermetically sealed container is disposed in the hub, and a reservoir is also disposed in the hub below the sealed container. A means is provided on said spool body for selectively permitting ink to transfer from said sealed container to said reservoir when it is desired to use said spool. Another means is provided for transferring ink from the reservoir to the pad. Both the reservoir and container are substantially sealed against the entry of air after the ink has been permitted to transfer from the container to the reservoir. Wicks disposed in the hub conduct ink from the reservoir to the pad by capillary action. The flow of ink from the reservoir to pad is regulated in a controlled manner due to the substantial air tight interior of the hub. A side edge of the ribbon contacts the pad whereby ink is communicated to the ribbon as it is unwound from the spool.

It is an object of the present invention to provide a printing ribbon spool of the type having internal ink storage means that may be stored in adverse conditions of heat and pressure without bleeding of the ink to the ink pad.

It is another object of the present invention to provide a self-inking printing ribbon spool that may be used on high speed printers.

It is still another object of the present invention to provide a self-inking printing ribbon spool that provides consistent print-out density as the ink is depleted.

It is still another an object of the present invention to increase the shelf life of known printing ribbon spools in a manner which is simple, inexpensive, and reliable.

FIG. 1 is a perspective view of a spool in accordance with the present invention.

FIG. 2 is an exploded view of the components of the spool shown in FIG. 1.

FIG. 3 is a sectional view taken along the line 3—3 in FIG. 1.

FIG. 4 is a sectional view taken along the line 4—4 in FIG. 3.

DETAILED DESCRIPTION

Referring to the drawing in detail, wherein like numerals indicate like elements, there is shown in FIG. 1 a printing ribbon spool in accordance with the present invention designated generally as 10.

The spool 10 has a body which includes a circular hub 12 having a radially outwardly directed flange 14 as its lower end and a radially outwardly directed flange 16 adjacent its upper end. The flanges 14 and 16 are spaced from one another and are parallel to one another. Flange 16 has a downwardly extending end portion 18 projecting toward the flange 14. The flanges 14 and 16 are of the same diameter. Flange 14 is integral with a bottom wall 22 of the body while flange 16 is integral with the stepped top wall 20 of the body. Hub 12 extends between wall 20 and flange 14.

The hub 12 is preferably provided with one or more flats 24 when being utilized on a Teletype printer. When two such flats are provided, the flats 24 are opposite one another. One of the flats serves to provide an acceptable surface for attachment, in any convenient manner, such as by ultrasonic welding, to one end of an inked ribbon 26. The other flat is utilized to provide take-up space for the metal reversing eyelet which effects reversing of the ribbon 26 on the Teletype printer. The terminal end portion of the ribbon constituting a length at least equal to the circumference of the hub 12 is either of reduced width or rendered ink impregnable such as by the use of an ink imprevious plastic shield so as to prevent ink from accumulating in the terminal end portion.

The hub 12 has a third flange 25 which extends radially outwardly. The length of the flange 25 in a radial direction is substantially less than the radial length of flanges 14 and 16. As shown more clearly in FIG. 3, flange 25 is closer to flange 16. The radial length of flange 25 exceeds the radial thickness of ribbon 26 which will accumulate on hub 12 of a fully wound spool 10.

An annular pad 28 is provided in the zone between flanges 16 and 25. Pad 28 is made from a material which is preferably slightly absorbent and of sufficient diameter so that the outer peripheral portion may extend downwardly through the annular gap defined by the outer periphery of flange 25 and the inner periphery of end portion 18. See FIG. 3.

The pad 28 is made from a flexible material which easily deforms so that its outer peripheral portion 30 may extend through said gap merely by the assembly of top wall 20 to the hub 12. Pad 28 readily adopts a cup-shape without any preforming. A preferred material for pad 28 is a material known in the garment trade as "bonded double knit". Bonded double knit material has been used for wearing apparel and is typically a 100% polyester double knit with a foam and 100% acetate backing. Thus, the bonded double knit material has a layer of foam plastic sandwiched between the bonded to a layer of double knit material such as polyester and a layer of knitted fabric such as acetate. The layer of foam is not necessary but is preferred since it acts as a stiffener and gives body to the pad 28. When pad 28 is made from said bonded double knit material, it is slightly absorbent so that it does not have excess ink therein during any shutdown time but rather merely acts as a transfer agent. In this regard, the material 28 acts as a hydrophobic material as compared with felt which is a hydrophilic material.

The body of spool 10 includes a core 32 integral with the bottom wall 22 at the center of the spool. Core 32 is concentric with the hub 12 and has a hollow interior open at its lower end. See FIG. 3. Immediately surrounding the lower end of core 32, there is provided a recess 34 on the bottom wall 22. Recess 34 is annular and adapted to receive a driver as is well known in the art. Recess 34 may be surrounded by an annular magnet embeded in the flange 14 for exerting sufficient force against a driver to avoid vibration, as explained in U.S. Pat. No. 3,819,026. Core 32 at its upper end is telescoped into a socket 36 integral with the top wall 20. The cooperation between core 32 and socket 36 assures that the top wall 20 is properly orientated with respect to the hub 12 and the bottom wall 22.

The body of spool 10 is preferably made from ink impervious lightweight material such as a polymeric plastic. A suitable polymeric plastic is a commercially available high crystalline acetal copolymer based on trioxane and sold under the name Celcon. Within the hub 12, there is provided a reservoir 33 for ink. Reservoir 33 is disposed on the bottom of hub 12 and is defined by the space between the outer wall of hub 12 and the side 23, and has a height substantially equal to the vertical distance between flange 14 and the bottom of a container 40. See FIGS. 3 and 4. Top wall 20 is bonded to hub 12 so that the interior of hub 12 is substantially hermetically sealed, except for wick holes 39 and a screw 50 extending through bottom wall 22 into reservoir 33. However, the diameter of wicks 38 is substntially greater than the diameter of the wick holes 39, so, after assembly of the spool 10, the presence of wick holes 39 has no significant effect on the hermetic seal, except as noted herein. Moreover, when screw 50 is turned inwardly a substantial hermetic seal is provided inside hub 12, and hence in reservoir 33, by means of an O ring 51, as explained hereinafter. It is not critical that a hermetic seal be maintained in the reservoir 33 before a sealed container 40 is pierced by the screw 50.

As shown in FIG. 4, the wicks 38 are diametrically opposite one another within the reservoir 33. Each wick 38 extends through corresponding restricted openings or wick holes 39 in the hub 12 and terminates in a location so as to be in contact with the material 28. The wicks 38 are preferably strips of woven or knitted fabric with a layer of ink impervious polymeric plastic disposed there between. The fabric may be nylon, silk, cotton, etc.

The container 40 is disposed internally of hug 12. Container 40 is hermetically sealed and is filled with ink. The container 40 has a centrally disposed sleeve 42 through which the core 32 extends. The container 40 is hermetically sealed at its upper end by a cover 44 having a central hole through which the core 32 extends.

The outer wall of the container 40 is provided with an indentation 46 for each of the wicks 38 so that the wicks 38 may extend upwardly from the reservoir 33, between the outer periphery of container 40 and the inner periphery of the hub 12 and through wick holes 39. See FIGS. 3 and 4. The bottom wall of the container 40 is provided with at least one weakened zone. The weakened zone may be provided in any convenient manner. A preferred manner for providing the weakened zone is to provide two areas 48 of reduced thickness. The areas 48 are diametrically opposite one another. Each indentation 46 on container 40 is opposite one of the flats 24. The relationship between indentations 46 and flats 24 assures that one of the areas 48 will always be aligned with screw 50.

The spool 10 is provided with a means for selectively fracturing one of the areas 48 so as to provide communication between the sealed container 40 and the reservoir 33. As illustrated, one such means for fracturing the area 48 may be screw 50 threaded to the bottom wall 22 of the spool 10. Screw 50 is turnable for movement in a direction parallel to the longitudinal axis of spool body 10. O ring 51 is disposed between the head of screw 50 and the bottom wall 22. When it is desired to provide communication between the reservoir 33 and the sealed container 40, it is only necessary to turn the screw 50 with a screwdriver until it fractures the area 48 and O ring 51 is seated tightly against the surface 53 of bottom wall 22. Screw 50 is preferably positioned so that its head is within a recess 52 when screw 50 has been turned inwardly. The threads of screw 50 operate as channels that slowly conduct ink out of the container 40 into reservoir 33 so that no flooding occurs inside the hub 12. Until area 48 is fractured by the screw 50, the spool 10 will have infinite shelf life since the ink remains sealed within the air tight container 40. O ring 51 defines a sealing means and ensures that the interior of hub 12, including reservoir 33, is substantially heremetically sealed after container 40 has been fractured by screw 50.

The use of a weakened zone which is readily fractured is one example of means for selectively permitting ink to transfer from container 40 to the reservoir 33. For example, screw 50 may be used to open a valve on container 40. The container 40 is preferably not completely filled so as to permit expansion of the ink under conditions such as flight in an airplane at high altitudes.

The spool 10 of the present invention has all of the advantages and attributes of the spool disclosed in U.S. Pat. No. 4,115,012.

As mentioned, the O ring 51 ensures that the interior of hub 12 is substantially hermetically sealed after container 40 is fractured by screw 50. Thus, both the reservoir 33 and container 40 are substantially sealed against the entry of air after ink has been permitted to flow from container 40 to reservoir 33. Ink travels from reservoir 33 to pad 28 by capillary action provided by wicks 38. The substantial air tight seal regulates the flow of ink from reservoir 33 to pads 28 in a controlled manner. A side edge of the ribbon 26 contacts the pad 28 as the ribbon 26 is unwound from the spool 10. As mentioned in U.S. Pat. No. 3,819,026, it is believed that the wiggling action of the pad 28 that occurs during unwinding of ribbon 26 primes or pumps the flow of ink through the wicks 38. When the spool is not in use, the capillary flow in ink along the wicks stops after a short period of time.

Maintaining the interior of hub 11 substantially air tight after container 40 has been fractured is an important feature of the invention. Although some air may leak into the hub via the wick holes 39, it is believed that this leakage may help to keep outgoing ink flowing through the wick holes in a controlled manner. It has been found that if air is permitted into the hub 12 or reservoir 33 other than at the wick holes after container 40 has been fractured, as by drilling a small air hole into hub 12, ink will flow from the reservoir 33 to the pad 28 in an uncontrolled condition during operation of the spool.

Unlike the printing ribbon spools disclosed in aforementioned U.S. Pat. Nos. 3,819,026 and 4,115,102, the level of ink in reservoir 33 never rises to or above the level of the wick holes 39. Ink is drawn from the reservoir 33 to the pad 28 only by capillary action. Thus, the rate of flow of ink from the reservoir is steady and continuous, resulting in uniform print density.

Because no ink is present in the reservoir 33 until sppol 10 is made ready for use by fracturing container 40, and further because the level of the ink in the reservoir never rises to the level of the wick holes, the diameter of the wick holes can be made larger than was possible with the prior art spools. Wick hole diameters of up to 0.135" have been tested with the present invention, thus allowing use with printers that can print in excess of 200 characters per second, i.e., the diameter of wick holes 39 can be made substantially larger without loss of control over ink flow and without undesired bleeding of ink.

Additionally, because no ink exists in reservoir 33 until spool 10 is made ready for use by fracturing container 40, the spools 10 may be shipped under adverse environmental conditions without the associated bleeding of ink experienced with prior art spools. Still further, because the ink is stored in a hermetically sealed container until it is ready for use, its shelf life is greatly increased.

Moreover, the spool of the present invention may be angularly or horizontally oriented, as is required in some printers, and still operate, as described herein.

The present invention may be embodied in other specific forms without departing from the spirit or essential attributes thereof and, accordingly, reference should be made to the appended claims, rather than to the foregoing specification, and indicating the scope of the invention.

I claim:

1. A rotatable printing ribbon spool comprising:

(a) an annular spool body having a hub disposed between a pair of spaced radially outwardly directed flanges for accommodating a printing ribbon therebetween;
(b) an annular pad supported by the spool body in a position so that an outer peripheral edge portion can have contact with a side edge of at least a portion of the ribbon disposed between the flanges;
(c) a sealed container of ink within the hub;
(d) a reservoir within the hub and below the sealed container;
(e) first means for selectively permitting ink to transfer from the sealed container to the reservoir;
(f) second means for transferring ink from the reservoir to the pad; and
(g) means for maintaining a substantial hermetic seal within the container and reservoir.

2. A printing ribbon spool according to claim 1 wherein the first means comprises means movably supported by the spool body for piercing the sealed container.

3. A printing ribbon spool according to claim 2 wherein the first means comprises screw means threaded to the spool body and being turnable for movement in a direction parallel to the axis of the body for piercing the sealed container.

4. A printing ribbon spool according to claim 3 wherein said means for maintaining a substantial hermetic seal within the container and reservoir comprises seal means disposed between the screw means and the spool body.

5. A printing ribbon spool according to claim 4 wherein the sealed container has an area of reduced thickness in one end wall for cooperation with the screw means.

6. A printing ribbon spool according to claim 1 wherein the second means comprises at least one wick extending from the reservoir and upwardly along an indentation in an outer peripheral wall of the sealed container and through an opening in the hub to the pad.

7. A printing ribbon spool according to claim 6 wherein the first means comprises means for piercing the sealed container to allow ink to transfer from the sealed container to the reservoir and seal means for maintaining the hermetic seal within the container and reservoir, the wick conducting ink from the reservoir to the pad in a controlled manner by capillary action.

8. A printing ribbon spool according to claim 7 wherein the hub has at least one flat thereon, the sealed container having a flat thereon juxtaposed to the flat on the hub.

9. A printing ribbon spool according to claim 8 wherein the sealed container has a pair of weakened areas in its end wall, the weakened areas being diametrically opposite one another, one of the areas being positioned for cooperation with the piercing means.

10. A rotatable printing ribbon spool comprising:
(a) an annular spool body having a hub disposed between a pair of spaced radially outwardly directed flanges for accommodating a printing ribbon therebetween;
(b) an annular pad of deformable material supported by the body in a position so that an outer peripheral edge portion of the pad can have contact with a side edge of at least a portion of a ribbon disposed between the flanges;
(c) a sealed container of ink coaxially disposed within the hub;
(d) a reservoir within the hub and below the sealed container;
(e) first means movably supported on the spool body for selectively permitting ink to transfer from the sealed container to the reservoir, including seal means for maintaining a substantial hermetic seal within the container and reservoir after the ink has been permitted to transfer from the sealed container to the reservoir; and
(f) second means for transferring ink from the reservoir to the pad in a controlled manner by capillary action.

11. A printing ribbon spool in accordance with claim 10 wherein the sealed container has an area of reduced thickness in one end wall defining a weakened area and the first means comprises piercing means threaded to the spool body and movable in a direction parallel to the axis of the spool body for fracturing the weakened area and permitting ink to flow into the reservoir.

12. A printing ribbon spool according to claim 11 wherein the seal means comprises an O ring disposed between the piercing means and the spool body for maintaining the hermetic seal in the container and reservoir after the sealed container has been fractured.

13. A printing ribbon spool according to claim 12 wherein the second means comprises at least one wick extending from the reservoir and upwardly along an indentation in an outer peripheral wall of the sealed container and through an opening in the hub to the pad.

14. A printing ribbon spool according to claim 13 wherein the hub has at least one flat thereon, the sealed container having a flat thereon juxtaposed to the flat on the hub.

15. A rotatable printing ribbon spool comprising:
(a) an annular spool body having a hub disposed between a pair of spaced, radially outwardly directed flanges for accommodating a printing ribbon therebetween;
(b) an annular pad of fabric supported by the spool body in a position so that an outer peripheral edge portion can have contact with a side edge of at least a portion of the ribbon disposed between the flanges;
(c) a sealed container of ink coaxially disposed within the hub and having a pair of diametrically opposed weakened areas in its end wall and a flat thereon juxtaposed to a flat on the hub;
(d) a reservoir within the hub and below the sealed container;
(e) a screw threaded to the spool body and being aligned with one of the weakened areas in the sealed container, the screw being turnable for movement in a direction parallel to the axis of the spool body to fracture the weakened area of the sealed container and permit ink to transfer from the sealed container to the reservoir;
(f) an O ring disposed between the screw head and the spool body for maintaining a substantial hermetic seal within the container and reservoir after the container has been fractured;
(g) at least one wick partially disposed in the reservoir and extending upwardly of the hub between an indentation in an outer peripheral wall of the sealed container and an inner surface of the hub and through an opening in the hub to the pad, the wick conducting ink from the reservoir to the pad in a controlled manner by capillary action when the container has been fractured.

16. A printing ribbon spool according to claim 15 further comprising mating surfaces on the hub and the container for orienting the container relative to the hub so that one of the weakened areas on the sealed container is aligned with the screw.

17. A rotatable printing ribbon spool transformable from a storage state to a usable state comprising:

(a) a spool body for accommodating a printing ribbon;

(b) a pad associated with a spool body and having a portion that can contact the ribbon as the ribbon is unwound from the spool;

(c) a container of ink within the spool body;

(d) a reservoir within the spool body;

(e) first means for transforming the spool from the storage state to the usable state by permitting the container to communicate with the reservoir; and (f) second means for transferring ink from the reservoir to the pad; wherein when the spool is in the storage state, the reservoir is empty and the container is completely sealed to prevent the escape of any ink therefrom to the reservoir; and (g) means for maintaining, a substantial hermetic seal within both the container and the reservoir when the spool is in the usable state so as to controllably regulate the flow of ink from the reservoir to the pad as the ribbon is unwound from the spool body.

18. Printing ribbon spool according to claim 17 wherein the first means comprises means accessible from the exterior of the spool body for piercing the container while maintaining the hermetic seal within the container and reservoir.

19. Printing ribbon spool according to claim 17 wherein the second means comprises at least one wick extending from the reservoir to and in contact with the pad.

20. Printing ribbon spool according to claim 19 wherein the wick extends from the reservoir to the pad through a wick hole in the spool body, the container and reservoir are coaxial, and the level of ink in the reservoir is always maintained below the level of the wick hole.

* * * * *